US005934524A

United States Patent [19]

Gray

[11] Patent Number: 5,934,524

[45] Date of Patent: Aug. 10, 1999

[54] MULTIPLE PURPOSE GARMENT AND ACCESSORY RACK

[76] Inventor: John Gray, 747 Red Oak La., University Park, Ill. 60622

[21] Appl. No.: 08/929,075

[22] Filed: Sep. 15, 1997

[51] Int. Cl.[6] ..... A47G 25/74

[52] U.S. Cl. ..... 223/85; 223/DIG. 1

[58] Field of Search ..... 223/85, DIG. 1, 223/92, 88, DIG. 2

[56] References Cited

U.S. PATENT DOCUMENTS

| | | | |
|---|---|---|---|
| D. 93,143 | 8/1934 | Spragg | 223/DIG. 1 |
| D. 175,456 | 8/1955 | Behlefeldt | 223/DIG. 1 |
| 3,762,570 | 10/1973 | Tobin . | |
| 3,777,894 | 12/1973 | Swenson . | |
| 3,783,995 | 1/1974 | Tobin . | |
| 3,945,500 | 3/1976 | Meckstroth | 223/DIG. 1 |
| 4,039,083 | 8/1977 | Leifheit et al. . | |
| 4,474,298 | 10/1984 | Bishop . | |
| 4,474,316 | 10/1984 | Philibert . | |
| 4,580,705 | 4/1986 | Wolfson et al. | 223/85 |
| 4,632,285 | 12/1986 | Dillingham . | |
| 4,709,838 | 12/1987 | Campbell . | |
| 5,303,855 | 4/1994 | Veale | 223/85 |
| 5,421,465 | 6/1995 | Dunner, Jr. . | |
| 5,437,378 | 8/1995 | Ta . | |
| 5,484,519 | 1/1996 | Fenton et al. . | |
| 5,526,968 | 6/1996 | Larson | 223/85 |

FOREIGN PATENT DOCUMENTS

| | | | |
|---|---|---|---|
| 2551090 | 5/1977 | Germany | 223/DIG. 1 |

OTHER PUBLICATIONS

Displayers, Belts Ties & Handbags, ABC Target, Spring/Summer 1997 Catalog.

Slatwall, Display Accessories, Spring/Summer 1997 Catalog.

Lillian Vernon, Spring 1997 Catalog.

Solutions to Small Problems, Homedecor, May 1997.

*Primary Examiner*—Bibhu Mohanty

*Attorney, Agent, or Firm*—Fitch, Even, Tabin & Flannery

[57] ABSTRACT

The present invention is directed to a multiple purpose garment rack which is particularly adapted for use on a closet support rod for supporting and retaining a number of neckties and other articles of clothing and accessories in a compact and versatile manner that is adapted for use in travel. The garment rack includes a hanging hook extending from a top portion and a plurality of tie support arms extending horizontally.

9 Claims, 8 Drawing Sheets

MULTIPLE PURPOSE GARMENT AND ACCESSORY RACK

The present invention relates to a garment rack for carrying neckties and other articles of clothing and accessories. More particularly, the present invention provides a versatile low cost garment rack for display and easy removal of neckties, articles of clothing and accessories, that is convenient for travel.

BACKGROUND OF THE INVENTION

There have been numerous garment racks, necktie or tie racks and hangers either proposed or used for a supporting a number of neckties, articles of clothing and accessories within a clothes closet. Many of the racks are designed for mounting on a vertical surface such as the inner surface of a swinging closet door. None of these racks are adaptable to or especially suited for travel.

One attempt at making the transport and display of neckties more convenient is illustrated in U.S. Pat. No. 3,945,500. These types of racks are portable and provide for the display of neckties. However, racks of this type are limited to being able transport and display neckties and are not capable of being used in connection with other articles of clothing and accessories.

A more versatile tie rack design is described in U.S. Pat. No. 3,783,995. Racks of this type do not hold neckties in a secure manner that is also convenient for use. Further, these racks are limited in not being adaptable for holding other articles of clothing such as a jacket or shirt.

It is an object of the present invention to provide a garment rack that is convenient for use in travel.

It is another object of the invention to provide a garment rack that is versatile in its ability to carry not only ties, but other articles of clothing and accessories.

Other objects, advantages, features and characteristics of the present invention will become more apparent upon consideration of the following description and the appended claims.

SUMMARY OF THE INVENTION

The present invention is directed to a multiple purpose garment rack which is particularly adapted for use on a closet support rod for supporting and retaining a number of neckties and other articles of clothing and accessories in a compact and versatile manner that is adapted for use in travel. The garment rack of the invention provides for displaying a group of ties within a compact space and for supporting the ties in a manner so that each individual tie may be easily selected for removal and also easily returned after use. In addition to supporting and displaying ties, the garment rack of the present invention is of sufficient size and rigidity such that a jacket can be hung on the rack. In one aspect of the invention, the rack can support ties, a jacket, slacks, and accessories such as belts. The garment rack has substantial durability and is inexpensive in construction in addition to being adapted for automatic production either with use of a plastics injection molding machine or by die cutting and scoring a sheet of semi-rigid plastics material or other sheet material.

In an important aspect of the invention, the garment rack has a generally rectangular frame portion formed of a single piece of semi-rigid material, the frame portion including an outside longitudinal edge, an inside longitudinal edge and a top portion. The garment rack includes a hanging hook extending from the top portion and a plurality of tie support arms extending horizontally from the inside longitudinal edge of the frame portion.

In an alternative aspect of the invention, the garment rack may include at least one horizontal support bar. In another alternative aspect, the garment rack includes an accessory holder extending downward from the top portion of the garment rack.

DETAILED DESCRIPTION OF THE INVENTION

Figure 1:
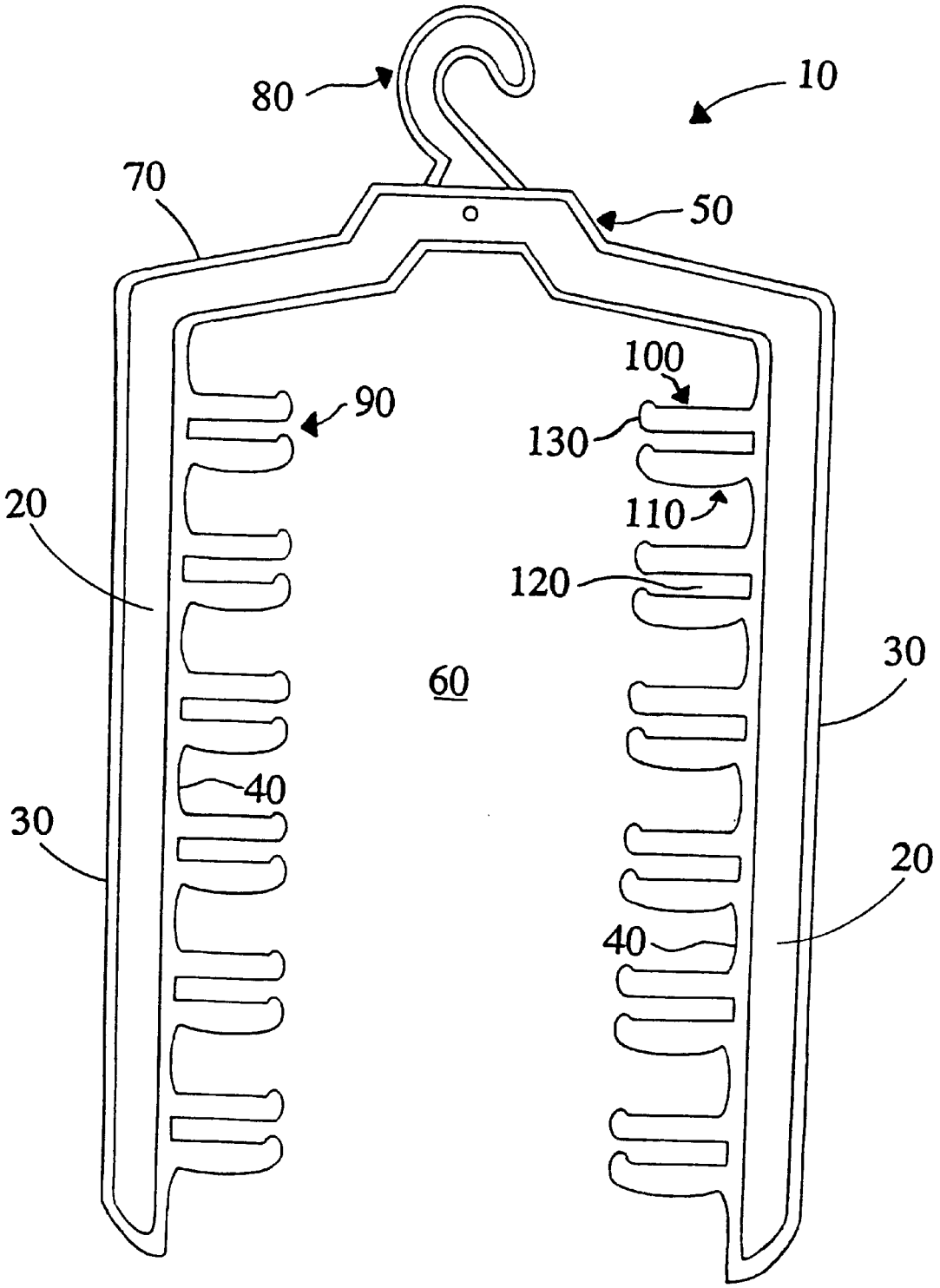
FIG. 1 is a front view of the garment rack of the invention.

Garment rack 10 of FIG. 1 is generally rectangular as illustrated and includes a frame portion 20 having an outside longitudinal edge 30, and inside longitudinal edge 40, and a top portion 50. The inside longitudinal edge 30 defines a space 60 in between either side of the frame portion 20 of the garment rack 10.

In an important aspect of the invention, the frame portion 20 is molded at a thickness and rigidity effective for supporting ties and other articles of clothing. The frame portion may be flat or rounded. In a very important aspect of the invention, the frame portion 20 is flat and has a thickness of about ⅛ inch to about ½ inch. The distance between the outside longitudinal edge 30 and inside longitudinal edge 40 is about ½ inch to about 1 and ½ inches, and the top portion 50 has a width of about 11 and ¾ inches to about 18 inches.

The garment rack 10 may be formed out of plastic, wood or metal materials. In an important aspect, the tie is injection molded of a single piece of plastic. The injection molding process can provide a textured surface or a smooth surface. The plastic used in the injection molding process may be of any type known in the art for such uses and includes, but is not limited to, polypropylene and polyethylene. Various pigments can be added to the plastic to provide a desired color.

In another aspect of the invention, the garment rack 10 includes a thickened beading 70 extending along each outside longitudinal edge 30 and the inside longitudinal edge 40 of frame portion 20. Beading also extends along edges of the top portion 50. The beading 70 is effective for providing the garment rack with sufficient stiffening such that it is able to stand up by itself if leaned or propped against a wall or object.

The top of garment rack 10 included an integral hanging hook 80. The hanging hook 80 allows the garment rack 10 to be placed over and removed from a closet bar. Hanging hook 80 curves downward towards the top of the tie rack 10.

Hanging hook 80 is formed of a material similar to frame portion 20 and has about the same thickness as the frame portion 20. In an important aspect, the hanging hook 80 has beadings similar to beadings 70 which extend along both edges.

In another aspect of the invention, hanging hook 80 is tapered such that it is thinner than frame portion 20. In this aspect, the thinner hanging hook 80 can be bent out of the plane of the tie rack 10.

In another aspect, hanging hook 80 may be rotatably connected to the top portion 50 of the garment rack 10. The rotatably connection allows the hanging hook 80 to be rotated around 360° and to be rotated downward to make the tie rack 10 more compact for storage. The rotatably connection may be a rivet or any other means known in the art to make such a connection.

In an important aspect, the garment rack 10 has an overall length, as measured from the top of hanging hook 80 to the bottom of frame portion 20 of about 22 and ¾ inches to about 31 and ½ inches. The garment rack 10 has a width, as measured from the outside longitudinal edge 30 to an opposite longitudinal edge 30, of about 11 and ¾ inches to about 18 inches.

Garment rack 10 includes a plurality of tie support arms 90 extending inwardly and into space 60 from the inside longitudinal edge 40 of frame portion 20. The tie support arms may be in the form of hooks or a straight projection. In one aspect of the invention, each tie support arm 90 includes an upper arm portion 100 and a lower arm portion 110 which defines a slot 120. In an important aspect, the lower arm portion 110 includes upturned end portion 130 that is effective for preventing ties from sliding horizontally into space 60 and falling off the tie support arm 90. Each tie support arm 90 extends into space 60 from inside longitudinal edge 40 about ½ inch to about 2 and ½ inches. Each tie support arm 90 has a width of about ½ inch to about 1 and ½ inch. Upper arm portion 100 and lower arm portion 110 can be the same width, but in an important aspect, upper arm portion 100 extends in a straight plan into space 60 and has a smaller diameter than lower arm portion 110, and lower arm portion 110 is thicker than upper arm portion 100 and is slightly beveled as shown in FIG. 1.

Figure 2:
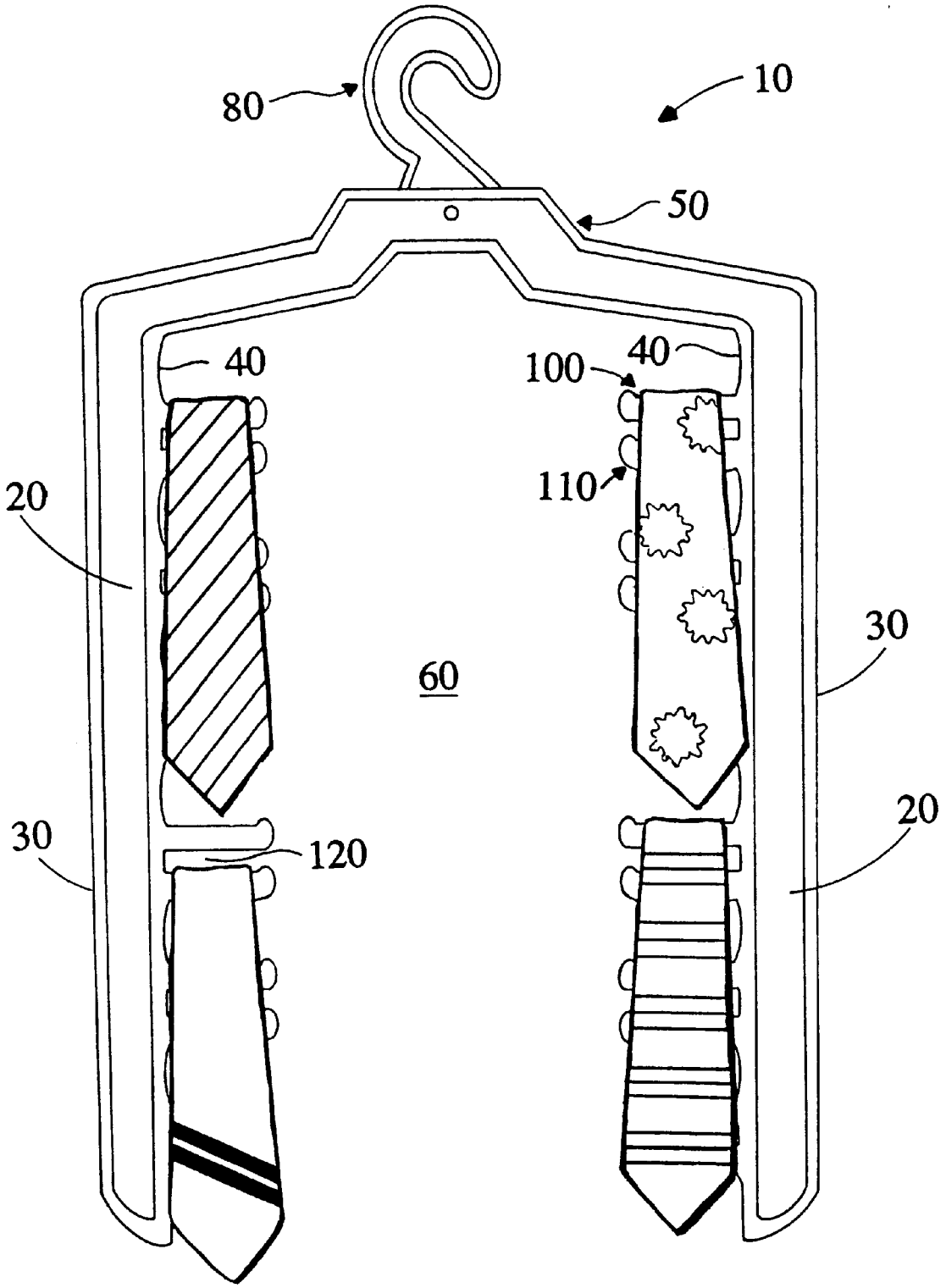
FIG. 2 is a front view of the garment rack of the invention with neckties loaded onto the rack.

FIG. 2. shows tie rack 10 with ties in place. As shown, ties may be placed inside slot 120 and may also be placed on top of upper arm portion 100.

Figure 3:
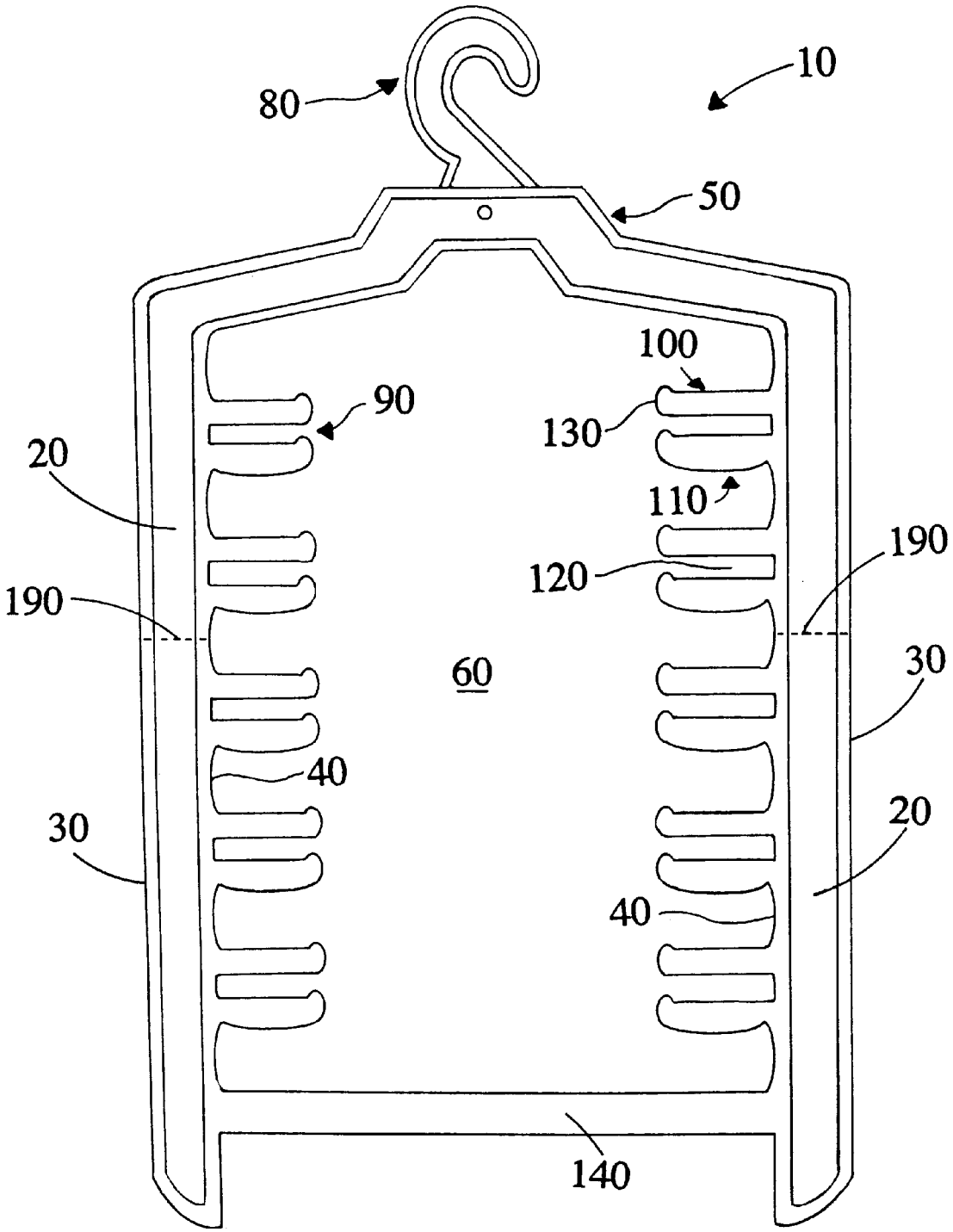
FIG. 3 is a front view of the garment rack of the invention that includes a horizontal support bar.

Another aspect of the invention is shown in FIG. 3. In this aspect, tie rack 10 includes at least one horizontal support bar 140 extending from and connecting opposite inside longitudinal edges 40. The horizontal support bar 140 may be located anywhere along the inside the length of the inside longitudinal edge 40, but in an important aspect, the horizontal support bar 140 is located toward the bottom half section of tie rack 10. Horizontal support bar 140 is effective for providing tie rack 10 with additional stability, and further allows the user to hang slacks over the support bar 140.

Figure 4:
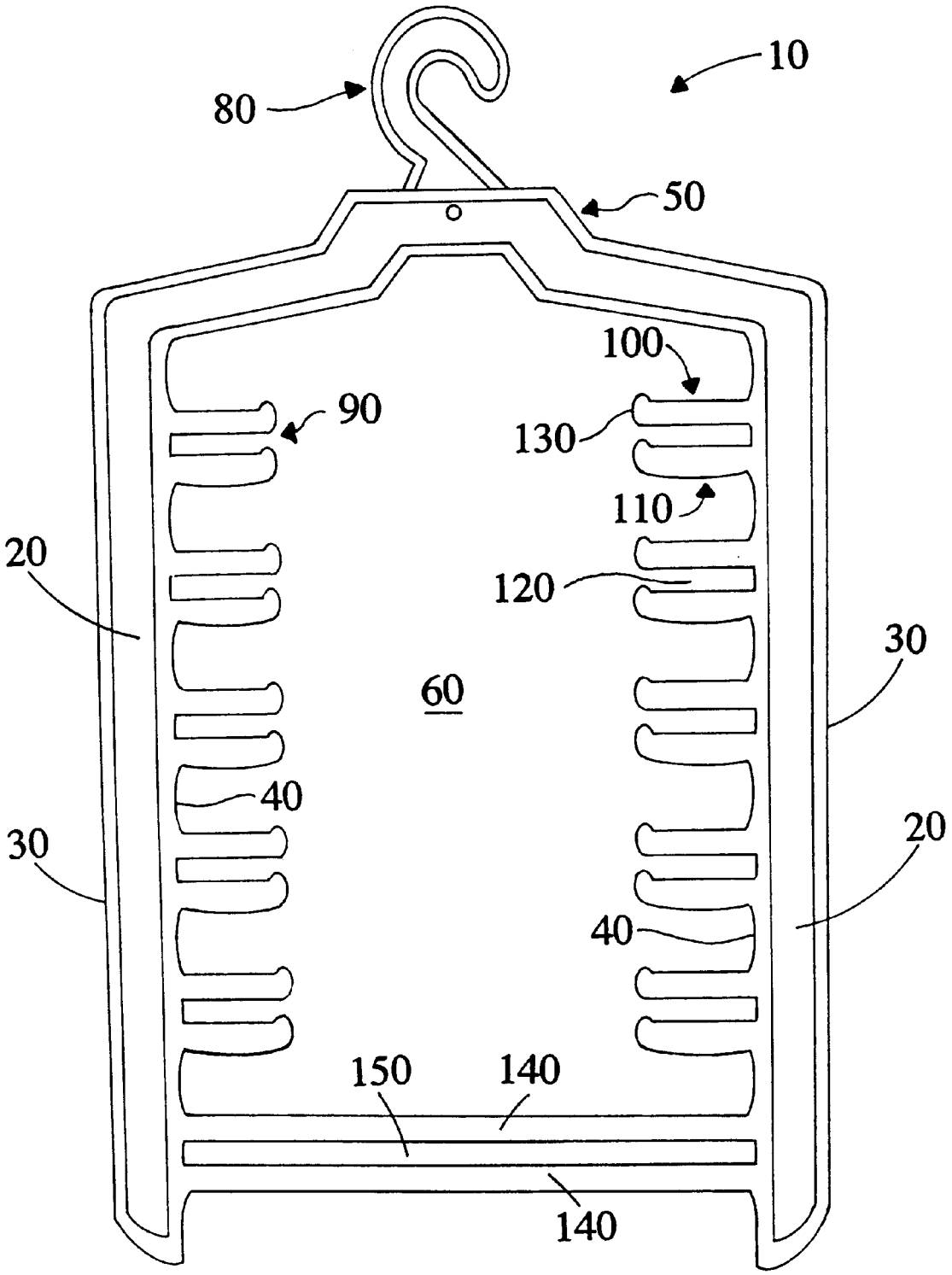
FIG. 4 is a front view of the garment rack of the invention that includes two horizontal support bars.

FIG. 4 shows another aspect of the invention where the tie rack 10 includes at least two horizontal support bars 140 which are spaced apart to define a horizontal slot 150. In this aspect, the horizontal slot 150 is of size effective to allow for slacks to be hung therein. In additional to slack being hung through horizontal slot 150, slacks may also be hung over the top horizontal support bar 140.

Figure 5:
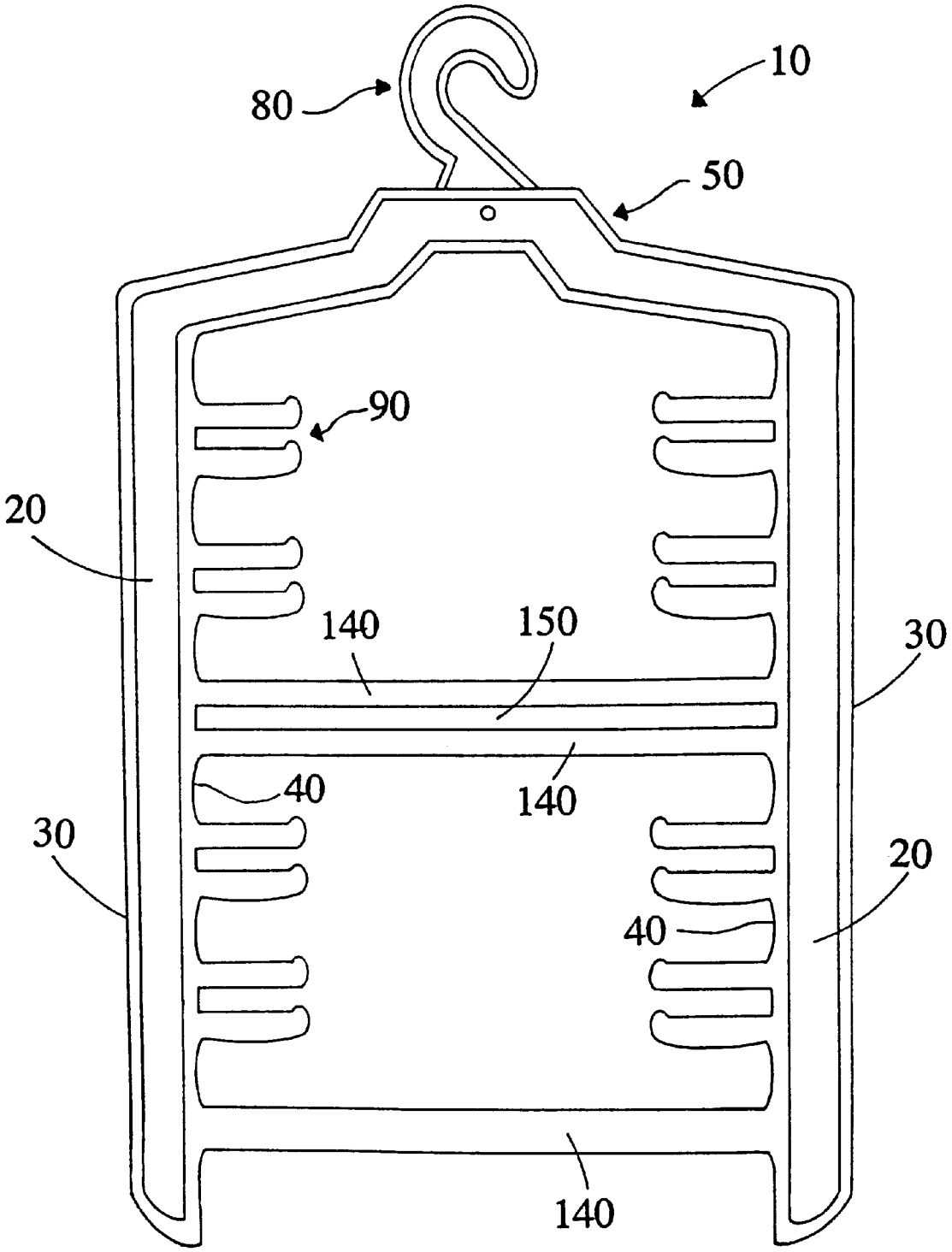
FIG. 5 is a front view of the garment rack of the invention that includes two horizontal support bars.

FIG. 5 shows an aspect of the invention where the tie rack 10 includes at least three horizontal support bars 140. In this aspect of the invention, a single horizontal support bar 140 is located towards the bottom half of tie rack 10 and two additional horizontal support bars 140 are located towards the top half of tie rack 10. The two horizontal support bars 140 located in the top half of the tie rack 10 are spaced apart to define a horizontal slot 150 which acts as a space for hanging slacks. In this aspect of the invention, slacks can be hung in horizontal slot 150 and on top of anyone of the horizontal support bars 140.

Figure 6:
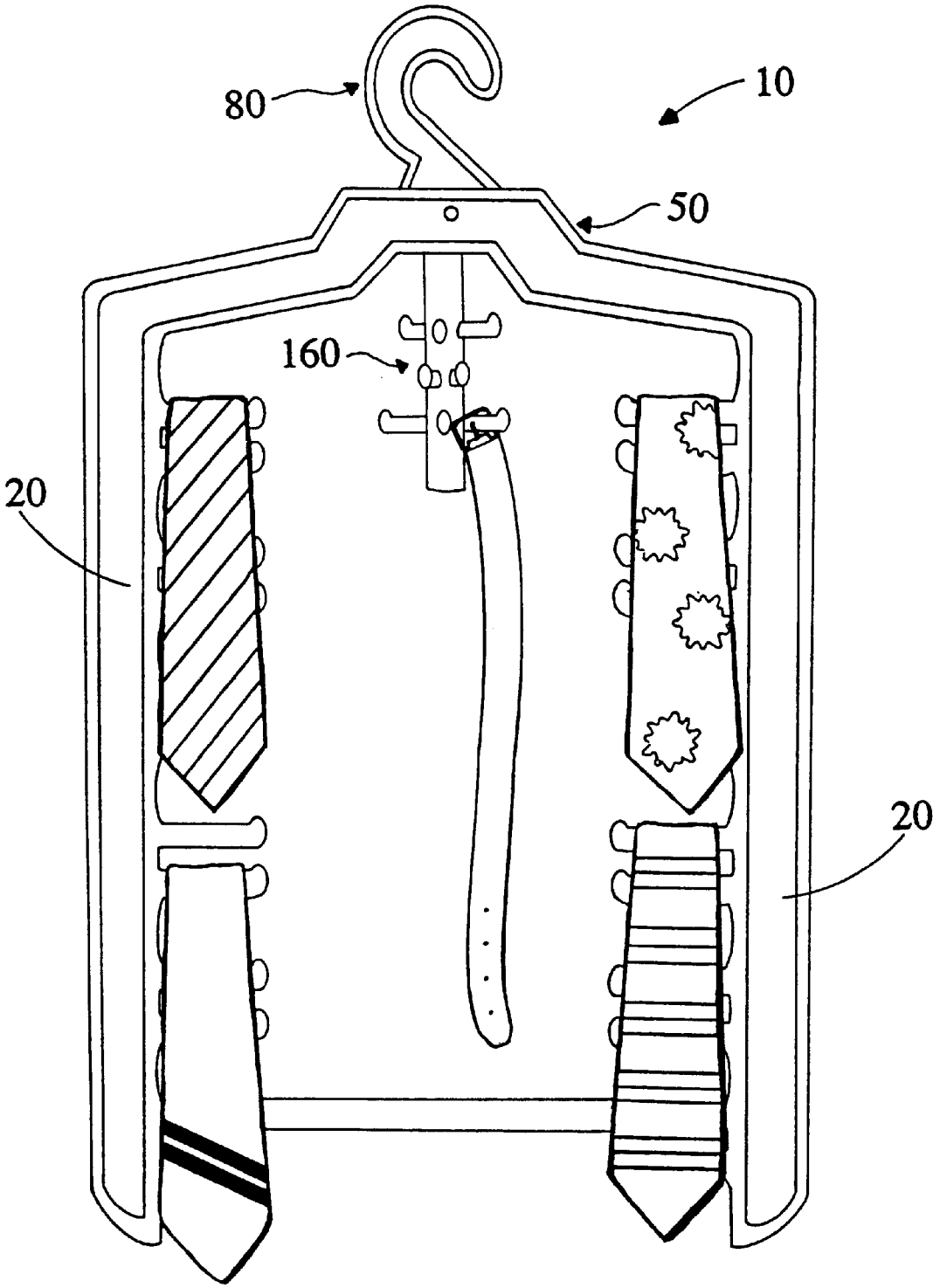
FIG. 6 is a front view of the garment rack of the invention that includes an accessory holder and shows ties and a belt loaded onto the rack.
Figure 7:
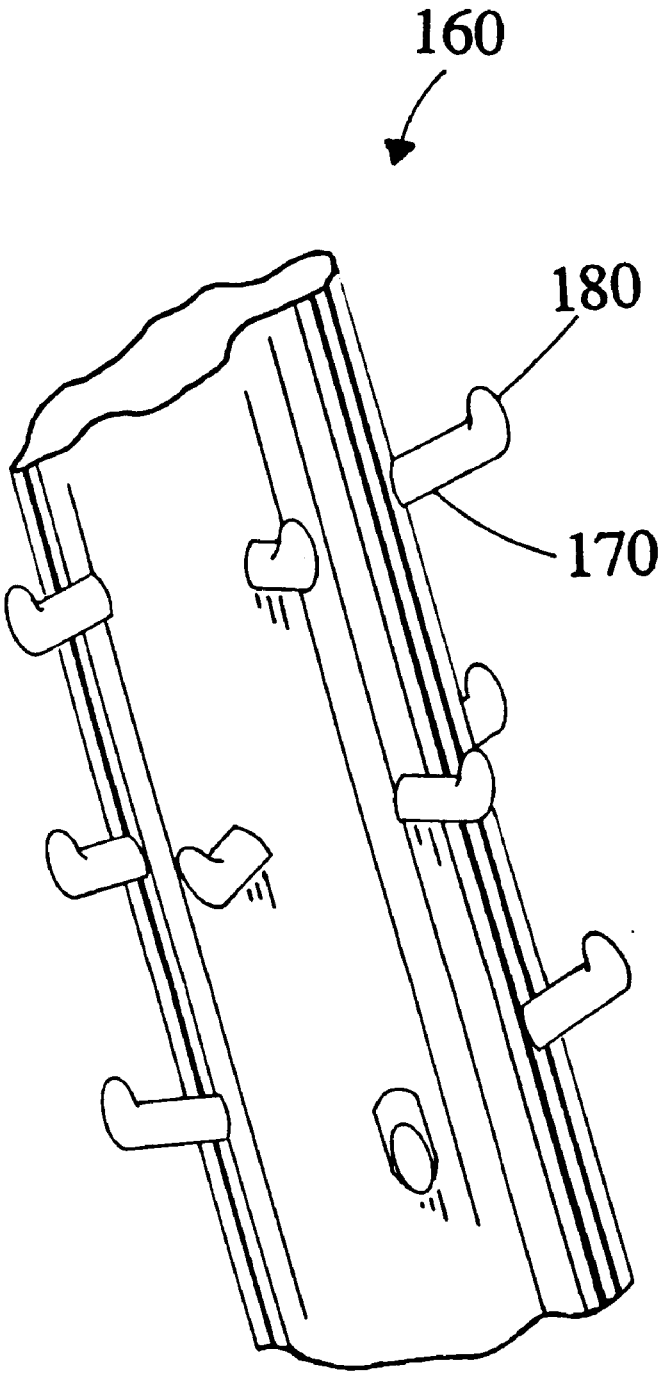
FIG. 7 is an enlarged view of the accessory holder.

FIG. 6 shows an aspect of the invention that includes an accessory holder 160. In an important aspect of the invention, an integral accessory holder 160 extends downward from the top portion 50 of tie rack 10 and into space 60. As is additionally shown in FIG. 7, the accessory holder 160 is generally rounded bar which includes a plurality of accessory hooks 170 extending horizontally. Each accessory hook 170 includes an upturned end portion 180 which is effective for securing accessory items such as a belt, and preventing those items from sliding off. In this aspect of the invention, the accessory holder 160 extends down from the top portion 50 of tie rack 10 about 4 inches to about 10 inches.

Figure 8:
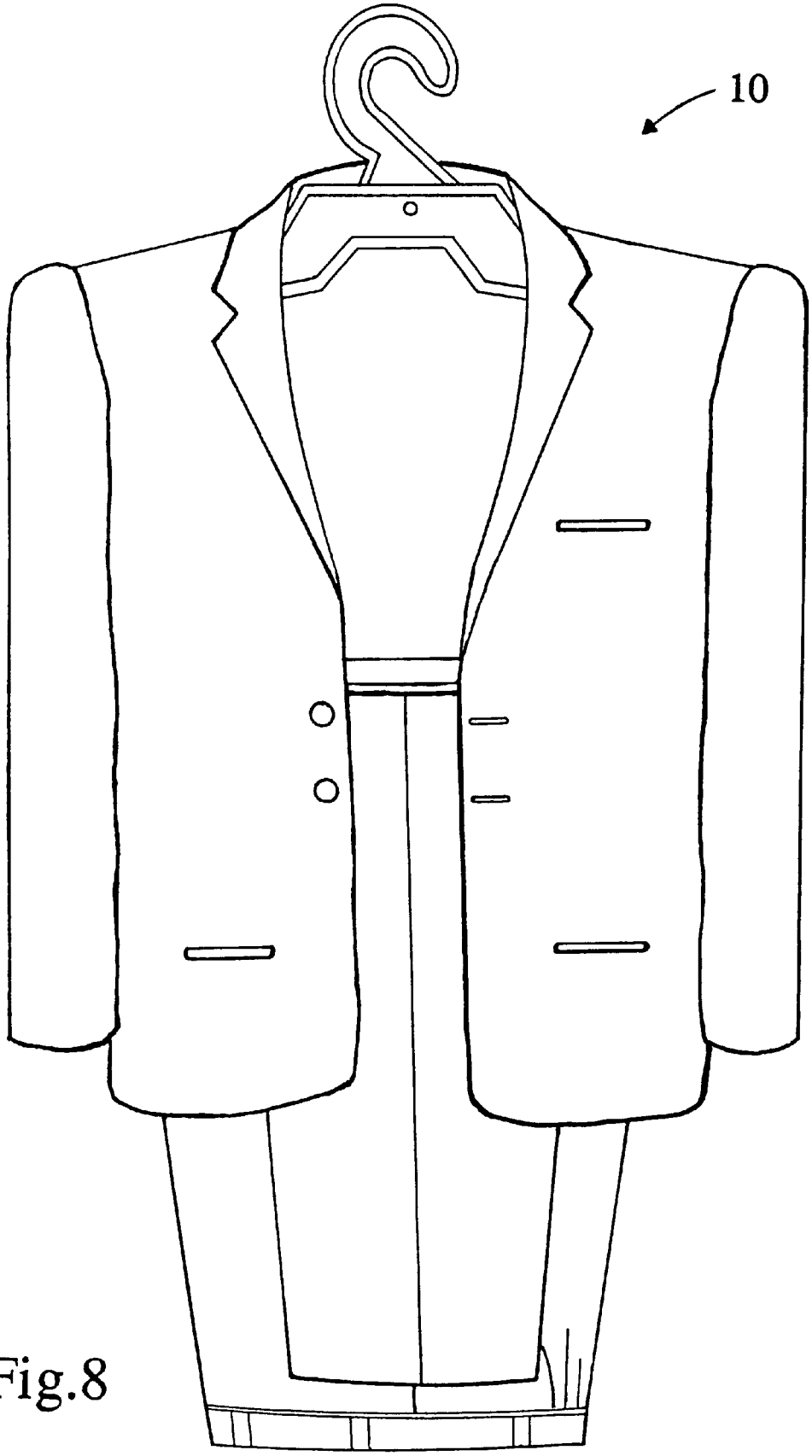
FIG. 8 is a front view of the garment rack of the invention with a coat and slacks loaded onto the rack.

In an important aspect of the invention, tie rack 10 is capable of holding ties, belts, slacks and a coat. FIG. 8 shows this aspect of the invention without the belt holder. The top portion 50 of garment rack 10 is tapered in an angular fashion up to the handing hook 80 such that a coat or shirt can be hung on the rack and supported thereon without the coat or shirt sliding off the rack.

In another aspect of the invention, the tie rack may include features which make the tie rack compact and more convenient for storage. As shown in FIG. 3, frame portion 20 may include hinges 190 on opposing side of the frame portion 20 that allow the tie rack to be folded in half. The hinges 190 may be conventional hinges or in an important aspect are formed as a thinned indented portion of the frame portion 20 which is bendable. Any of the variations of the tie racks shown and discussed herein may include the hinge feature.

Numerous modifications and variations in practice of the invention are expected to occur to those skilled in the art upon consideration of the foregoing detailed description of the invention. Consequently, such modifications and variations are intended to be included within the scope of the following claims.

What is claimed is:

1. A garment rack comprising:

a generally rectangular frame portion formed of a single piece of semi-rigid material, the frame portion including an outside longitudinal edge, an inside longitudinal edge on each longitudinal side of the frame portion, at least one horizontal support arm connecting opposite inside longitudinal edges, and a top portion, the inside edge on each longitudinal side of the frame portion, the horizontal support arm, and the top portion defining an open space;

a hanging hook extending from the top portion; and a plurality of tie support arms extending horizontally from each inside longitudinal edge of the frame portion partially into the open space defined by the inside edge on each longitudinal side of the frame portion, the horizontal support arm, and the top portion.

2. The garment rack of claim 1, wherein the garment rack is injection molded of a single piece of plastic.

3. The garment rack of claim 1, wherein the frame portion is flat.

4. The garment rack of claim 1, wherein the tie support arms include an upper arm portion, a lower arm portion and a slot.

5. A garment rack comprising:

a generally rectangular frame portion formed of a single piece o f semi-rigid material, the frame portion including an outside longitudinal edge, an inside longitudinal edge on each longitudinal side of the frame portion, at least one horizontal support arm connecting opposite inside longitudinal edges, and a top portion, the inside edge on each longitudinal side of the frame portion, the horizontal support arm, and the top portion defining an open space;

a hanging hook extending from the top portion; and an accessory holder extending downward from the top portion partially into the open space.

6. The garment rack of claim 5, wherein the garment rack is injection molded of a single piece of plastic.

7. The garment rack of claim 5, wherein the frame portion is flat.

8. The garment rack of claim 5, wherein the tie support arms include an upper arm portion, a lower arm portion and a slot.

9. The garment rack of claim 5, wherein the accessory holder includes a plurality of accessory hooks.

* * * * *